US011480398B2

(12) United States Patent
Hemker et al.

(10) Patent No.: US 11,480,398 B2
(45) Date of Patent: Oct. 25, 2022

(54) COMBINING COMPLEX FLOW MANIFOLD WITH THREE DIMENSIONAL WOVEN LATTICES AS A THERMAL MANAGEMENT UNIT

(71) Applicant: THE JOHNS HOPKINS UNIVERSITY, Baltimore, MD (US)

(72) Inventors: Kevin J. Hemker, Reisterstown, MD (US); Timothy P. Weihs, Baltimore, MD (US); Stephen Ryan, Towson, MD (US); Longyu Zhao, Baltimore, MD (US); Seunghyun Ha, Nam-gu Busan (KR); Yong Zhang, Baltimore, MD (US); James K. Guest, Lutherville Timonium, MD (US)

(73) Assignee: The Johns Hopkins University, Baltimore, MD (US)

( * ) Notice: Subject to any disclaimer, the term of this patent is extended or adjusted under 35 U.S.C. 154(b) by 591 days.

(21) Appl. No.: 15/161,849

(22) Filed: May 23, 2016

(65) Prior Publication Data

US 2016/0341495 A1 Nov. 24, 2016

Related U.S. Application Data

(60) Provisional application No. 62/165,383, filed on May 22, 2015, provisional application No. 62/238,310, filed on Oct. 7, 2015.

(51) Int. Cl.

| | |
|---|---|
| ***F28F 9/02*** | (2006.01) |
| ***F28F 21/06*** | (2006.01) |
| ***F28F 13/00*** | (2006.01) |

(52) U.S. Cl.

CPC ..... *F28F 9/02* (2013.01); *F28F 13/00* (2013.01); *F28F 21/067* (2013.01)

(58) Field of Classification Search

CPC .. F28F 9/02; F28F 13/00; F28F 21/067; F28F 9/026; F28F 9/0263; F28F 9/027;

(Continued)

(56) References Cited

U.S. PATENT DOCUMENTS 828,807 A * 8/1906 Bolton ..... F28D 7/12 122/470

2,097,602 A * 11/1937 Rohlin ..... F28F 9/0217 237/74

(Continued)

OTHER PUBLICATIONS

Browne, E., et al., "Microjet array single-phase and flow boiling heat transfer with R134a" Int J Heat Mass Transf (2010) vol. 53, pp. 5027-5034.

(Continued)

*Primary Examiner* — Tho V Duong
*Assistant Examiner* — Raheena R Malik
(74) *Attorney, Agent, or Firm* — Harrity & Harrity, LLP

(57) ABSTRACT

The present invention is directed to a manifold for directing cooling fluid and/or gas to a heat exchanger in a flow configuration designed to optimize heat transfer from the heat exchanger. The manifold can take many different forms such as a layered construction with distributed inlet paths, local outlet paths, a central collection changer and a path for fluid removal. The manifold can be formed from a metal, plastic, rubber, ceramic, or other heat resistant material known to or conceivable by one of skill in the art. The manifold can also be combined with any type of heat exchanger known to or conceivable by one of skill in the art to form a thermal management unit. To optimize overall properties such as low pressure drop, high heat transfer, and excellent temperature uniformity of the thermal management unit, the manifold can be graded, expanded and scaled as needed.

38 Claims, 11 Drawing Sheets

(58) Field of Classification Search
CPC ..... F28F 9/0273; F28F 9/0275; F28F 3/086; H01L 23/4336; H01L 23/4735; H01L 23/473
USPC ..... 165/173
See application file for complete search history.

(56) References Cited

U.S. PATENT DOCUMENTS 2,950,092 A * 8/1960 Di Niro ..... F28F 9/02 165/150
3,361,195 A * 1/1968 Motto, Jr. ..... H01L 23/4735 165/80.4
4,138,692 A * 2/1979 Meeker ..... H01L 23/4332 165/80.4
4,759,403 A * 7/1988 Flint ..... H01L 23/4332 165/80.4
4,920,574 A * 4/1990 Yamamoto ..... H01L 23/4332 165/80.4
5,177,667 A * 1/1993 Graham ..... H01L 23/4336 257/714
5,251,694 A * 10/1993 Chigira ..... F28D 1/05383 165/153
5,270,572 A * 12/1993 Nakajima ..... H01L 23/4735 165/104.33
5,294,830 A * 3/1994 Young ..... H01L 23/4338 165/80.4
5,309,319 A * 5/1994 Messina ..... H01L 23/4336 165/142
5,323,850 A * 6/1994 Roberts ..... F28B 1/06 165/151
5,479,985 A * 1/1996 Yamamoto ..... F28D 1/05391 165/153
5,769,157 A * 6/1998 Ikejima ..... B23K 1/0012 165/184
5,873,409 A * 2/1999 Letrange ..... F28F 9/02 165/173
6,640,887 B2 * 11/2003 Abell ..... F28F 9/0214 165/173
6,827,139 B2 * 12/2004 Kawakubo ..... F28D 1/0476 165/173
6,986,382 B2 * 1/2006 Upadhya ..... F04B 19/006 165/104.21
6,988,534 B2 * 1/2006 Kenny ..... F04B 17/00 165/104.21
7,040,381 B2 * 5/2006 Eisele ..... F28F 3/086 165/80.4
7,188,662 B2 * 3/2007 Brewer ..... H01L 23/473 165/80.4
7,367,203 B2 * 5/2008 Katoh ..... F25B 39/02 62/515
7,637,314 B2 * 12/2009 Park ..... F28F 9/0278 165/174
7,650,935 B2 * 1/2010 Demuth ..... F28D 1/0478 165/176
7,942,020 B2 * 5/2011 Knight ..... F25B 39/00 62/519
8,322,407 B2 * 12/2012 Reynolds ..... F24H 3/0429 165/173
8,376,029 B2 * 2/2013 Rericha ..... F28D 1/022 165/153
8,776,873 B2 * 7/2014 Mross ..... F28D 1/05391 165/173
8,974,934 B2 * 3/2015 Merriman ..... F28F 9/0243 165/157
2003/0188857 A1 * 10/2003 Kawakubo ..... F28D 1/0476 165/174
2003/0217838 A1 * 11/2003 Dey ..... F28D 1/0535 165/173
2004/0112571 A1 * 6/2004 Kenny ..... F04B 17/00 165/80.3
2004/0159121 A1 * 8/2004 Horiuchi ..... F25B 39/02 62/526
2004/0182560 A1 * 9/2004 Kenny ..... F28F 3/086 165/185
2005/0211417 A1 * 9/2005 Upadhya ..... F04B 19/006 165/80.4
2005/0211418 A1 * 9/2005 Kenny ..... F04B 17/00 165/80.4
2005/0211427 A1 * 9/2005 Kenny ..... F28D 15/0266 165/299
2006/0090888 A1 * 5/2006 Huang ..... F28D 1/024 165/174
2006/0250774 A1 * 11/2006 Campbell ..... H01L 23/4735 361/699
2010/0031507 A1 * 2/2010 Shah ..... F28F 9/0224 29/890.052
2014/0190665 A1 * 7/2014 Joshi ..... H01L 23/427 165/104.19
2014/0190668 A1 * 7/2014 Joshi ..... H01L 23/427 165/104.33
2016/0363392 A1 * 12/2016 Winterstten ..... F28F 9/02

OTHER PUBLICATIONS

Zhao, L., et al., "Permeability measurements and modeling of topology-optimized metallic 3-D woven lattices" Acta Mater (2014) vol. 81, pp. 326-336.
Boomsma, K., et al., "Metal foams as compact high performance heat exchangers" Mech Mater (2003) vol. 35, pp. 1161-1176.
Jiang PX., et al., "Experimental research on convection heat transfer in sintered porous plate channels" Int J Heat Mass Transf (2004) vol. 47, pp. 2085-2096.

* cited by examiner

COMBINING COMPLEX FLOW MANIFOLD WITH THREE DIMENSIONAL WOVEN LATTICES AS A THERMAL MANAGEMENT UNIT

CROSS REFERENCE TO RELATED APPLICATIONS

This application claims the benefit of U.S. Provisional Patent Application No. 62/165,383 filed May 22, 2015 and U.S. Provisional Patent Application No. 62/238,310 filed Oct. 7, 2015, which are incorporated by reference herein, in their entirety.

GOVERNMENT RIGHTS

This invention was made with government support under W91CRB1010004 awarded by the Defense Advanced Research Projects Agency. The government has certain rights in the invention.

FIELD OF THE INVENTION

The present invention relates generally to heat exchange. More particularly the present invention relates to a complex flow manifold for use with a heat exchanger to form a multi-functional thermal management unit.

BACKGROUND OF THE INVENTION

Although common heat exchangers, such as tube, shell, or fin structures, or metallic foams have proven to transfer heat effectively, limitations include precise control of flow patterns, temperature distributions, pressure drops, etc. In addition, scaling up the manufacturing and modeling of these units from the micro-scale to the macro-scale can be time consuming and expensive.

Traditional heat exchangers employ axial flow and have inherent temperature gradients. Using distributed, multi-directional flow requires multiple cells within the thermal management unit. Creating local cells requires inlet and outlet flow channels (localized plumbing and connections) that can be challenging and costly to manufacture.

For traditional heat exchangers and common heat exchange applications, quantities such as heat transfer coefficient, pumping power, average temperature, etc. are global or macro-scale properties, measured across the whole device being cooled. However, in some applications, such as laser diodes, temperature uniformity is also a concern and temperature distributions must be controlled at the local or micro-scale level and this can be challenging.

Designing and modeling a heat exchange unit at the small or micro-scale is common, but scaling up the local or micro-scale design to cover large areas can be challenging. Difficulties may include manufacture constraints associated with expanding the geometry of the design and computational costs associated with modeling the performance of a large-scale structure. Further still, discrepancies may appear in modeling when the sizes are expanded, causing inaccuracies in the prediction of bulk properties.

It would therefore be advantageous to provide a complex flow manifold that when combined with a heat exchanger provides many local, thermal management cells that are designed to optimize multiple properties simultaneously and allow for scale-up of the many thermal management cells into a thermal management unit of indefinite size but identical properties.

SUMMARY

Figures 1A, 1B, 1C, 1D:
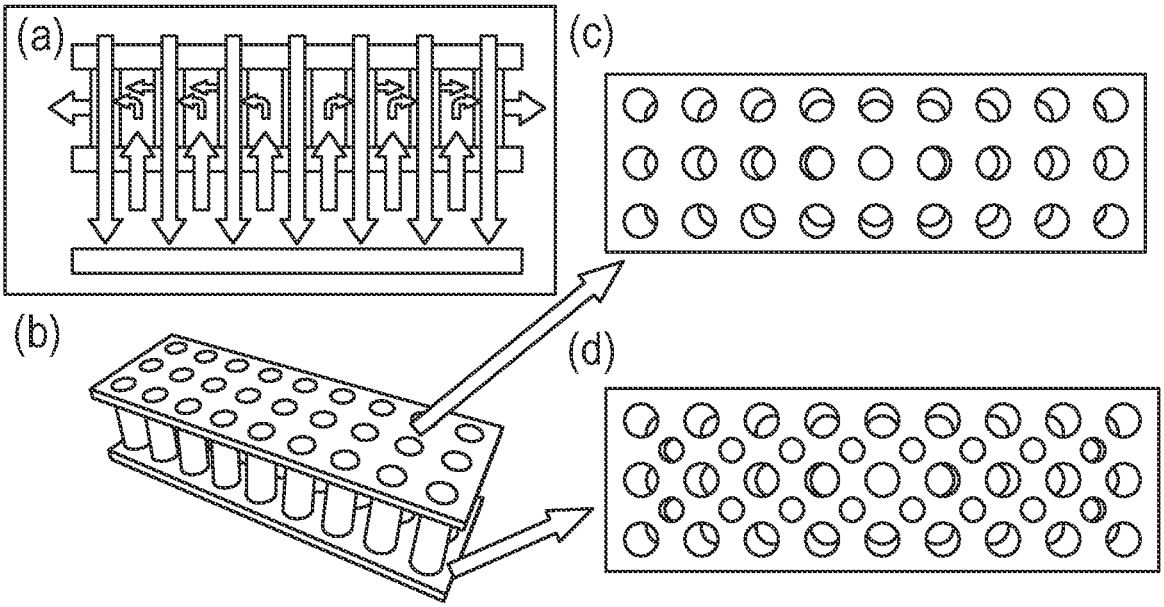
FIGS. 1A-1D illustrate a schematic diagram and images of the underlying principle of the complex flow manifold of the present invention.

The foregoing needs are met, to a great extent, by the present invention, wherein in one aspect the present invention includes a complex flow manifold includes a body defining openings. The openings are configured for directing fluid into and away from a heat exchange device. The complex flow manifold is configured such that one or more properties are enhanced.

In accordance with an aspect of the present invention, the one or more properties that are enhanced include pressure drop, pumping power, heat transfer, and temperature uniformity. The manifold is formed from a metal, a non-metal, such as a polymer or a ceramic, a mixture of materials, or different materials used in different portions of the manifold. The manifold can be additive manufactured with metals. Alternately, the manifold can be additive manufactured with plastics. The diameters of the channels or holes within the manifold are the same or different. The manifold is configured to direct fluid in the form of water, air or other coolants. The manifold is repeated and expanded in three directions. The manifold is placed with gradients in three directions. The distribution channels of the manifold can be straight, curved or waved. The inlet and outlet distribution channels of the manifold can either intersect to make a joint connection or be independent. The angles between inlet and outlet distribution channels of the manifold can take any angle between 0 degree (parallel) to 90 degrees (perpendicular) in three directions. Topology optimization is performed so as to design a manifold with properties that are optimized in one or more directions. The fluid flow within the manifold can be designed so as to also optimize thermal conductivity, electrical conductivity, mechanical strength, material density, energy absorption, or damping properties required for fluid flow applications.

In accordance with another aspect of the present invention, a thermal management unit includes a complex flow manifold and a heat exchanger. The thermal management unit is configured such that one or more properties are enhanced.

In accordance with yet another aspect of the present invention, the one or more properties that are enhanced include pressure drop, pumping power, heat transfer, and temperature uniformity. The manifold is formed from a metal, a non-metal, such as thermoplastic or ceramic, a mixture of materials, and different materials used in different portions of the manifold. The manifold is additive manufactured with metals at high speed and great quality. Alternately, the manifold is additive manufactured with plastics at high speed and great quality. The diameters of the channels within the manifold are the same or different. The manifold is configured to direct fluid in the form of water, air or other coolants. The manifold is repeated and expanded in three directions. The manifold is placed with gradients in three directions. The distribution channels of the manifold can be straight, curved or waved channels. The inlet and outlet distribution channels of the manifold can either intersect to make a joint connection or be independent. The angles between inlet and outlet distribution channels of the manifold can take any angle between 0 degree (parallel) to 90 degrees (perpendicular) in three directions. Topology optimization is performed so as to design the thermal management unit with properties that are optimized in one or more directions. The heat exchanger in the thermal management unit can take the form of 3D woven lattices, fins, pins, trusses, foams or other cellular materials. The thermal management unit can be accommodated to systems with multiple surfaces which attach to devices and need cooling. The thermal management unit can be tailored to any geometry to satisfy any flat or curved surfaces which need cooling.

DETAILED DESCRIPTION OF THE PREFERRED EMBODIMENTS

The presently disclosed subject matter now will be described more fully hereinafter with reference to the accompanying Drawings, in which some, but not all embodiments of the inventions are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated drawings. Therefore, it is to be understood that the presently disclosed subject matter is not to be limited to the specific embodiments disclosed and that modifications and other embodiments are intended to be included within the scope of the appended claims.

The present invention is directed to a complex flow manifold for directing cooling fluid and/or gas to a heat exchanger in a flow configuration designed to optimize heat transfer from the heat exchanger. The manifold can take many different forms such as a layered construction with distributed inlet paths, local outlet paths, a central collection changer and a path for fluid removal. The manifold can be formed from a metal, plastic, ceramic, rubber, or other heat resistant material known to or conceivable by one of skill in the art. The manifold can also be combined with any type of heat exchanger known to or conceivable by one of skill in the art. To optimize overall properties of the thermal management unit such as low pressure drop, high heat transfer, and excellent temperature uniformity, the manifold can be graded, expanded and scaled as needed. These manifolds also provide the added benefit that modeling can be performed on local thermal management cells and homogenized across the entire thermal management unit.

A manifold according to the present invention can include a layered construction design with distributed inlet and outlet paths. The manifold can include a central collection chamber and path for removal of fluid and/or gas. The design described above allows for simple and cost effective manufacturing of the complex flow manifold and the associated plumbing devices.

A device for heat transfer, according to an embodiment of the present invention can also take the form of a thermal management unit (TMU) combining a complex flow manifold (CFM) with a heat exchanger (three dimensional (3D) structures, 3D woven lattices, open channels, pins, fins, trusses, foams, etc.). This combination of components can be used and optimized to control flow, temperature, and pressure drop, as desired. Both the CFM and heat exchangers can provide regular, micro-scale thermal management cells that control properties at the small or micro-scale. The thermal management cell includes at least one inlet and one outlet within the CFM and the associated volume of the heat exchanger. For different application purposes, the pattern of the inlet and outlet paths of the CFM and the architecture or design of the heat exchanger can be tailored to achieve desired properties within a given thermal management cell. These properties may include a limited pressure drop, a limited uniform temperature distribution, a high level of heat transfer, etc.

When combining the manifold with a heat exchanger, the CFM and heat exchanger are segregated into many identical thermal management cells (TMC) despite their original size. This way the volume to be optimized within the design step can be managed independent of the scale of an application for a given thermal management unit (TMU). Fluidic and thermal conditions can be treated similarly between different cells when the size of the cells is much smaller than the scale of the overall TMU. Simulations can also be performed within each TMC and extended to the full scale TMU, which dramatically reduces computational cost.

The manifold, heat exchanger and thermal management unit of the present invention can be implemented in a number of ways in order to provide heat transfer. The design and manufacture of the device can be varied in order to optimize different properties of heat transfer. A number of examples and ranges are given below, with respect to the design, properties, materials, and manufacture of a device according to the present invention. These examples and ranges are in no way meant to be considered limiting, and any suitable design, property, material, or method of manufacture known to or conceivable by one of skill in the art could also be used. It should be noted that as used throughout the present application "optimize" and variations thereof are understood to be the choice of certain designs, properties, materials, manufacture processes, etc. to provide the desired results from the present invention for a predetermined set of parameters.

The present invention can take the form of a CFM that enables the flow of cooling fluid and gas both towards and away from the hot surface counter-currently. More particularly, the CFM segments a large cooling surface into many small unit cells, TMCs, for minimizing ΔP across its area. The TMC sizes are between approximately 1 mm to 10 mm. Many features of the impinging and collecting tubes can be optimized to minimize ΔP, such as: sizes, thicknesses, quantity ratios (ratio of inlet to outlet flow), and arrangements.

Alternately, the CFM can segment a large cooling surface into many small unit cells, TMCs, for minimizing ΔT across its area. In such an implementation. The TMC sizes are between approximately 1 mm to 10 mm. Many features of the impinging and collecting tubes can be optimized to minimize ΔT, such as: sizes, thicknesses, quantity ratios, and arrangements.

The CFM can segment a large cooling surface into many small unit cells, TMCs, for maximizing heat transfer across its area. The TMC sizes are between approximately 1 mm to 10 mm. Many features of the impinging and collecting tubes can be optimized to maximize heat transfer, such as: sizes, thicknesses, quantity ratios, and arrangements.

The present invention can take the form of a thermal management unit (TMU) combining a CFM and a heat exchanger such as 3D structure or a 3D woven lattice. The thermal management unit can be optimized for different variables including minimizing ΔP, ΔT, and maximizing heat transfer either alone or in combination. For minimizing ΔP, the design of the CFM and the design of the heat exchanger, such as the weaving pattern of the 3D woven lattice, are optimized for minimizing ΔP. Many features of the impinging and collecting tubes and weaving pattern can be optimized to minimize ΔP, such as: sizes, thicknesses, quantity ratios, arrangements, thickness ratio and individual thickness between the CFM and the weave, wherein the thickness ration is a ratio of manifold to weave thickness. For minimizing ΔT, the design of the CFM and the design of the heat exchanger, such as the weaving pattern of the 3D woven lattice, are optimized for minimizing ΔT. Many features of the impinging and collecting tubes and weaving pattern can be optimized to minimize ΔT, such as: sizes, thicknesses, quantity ratios, arrangements, thickness ratio and individual thickness between the CFM and the weave. For maximizing heat transfer, the design of the CFM and the design of the heat exchanger, such as the weaving pattern of the 3D woven lattice, are optimized. Many features of the impinging and collecting tubes and weaving pattern can be optimized to maximize heat transfer, such as: sizes, thicknesses, quantity ratios, arrangements, thickness ratio and individual thickness between the CFM and the weave. For each of minimizing ΔP, ΔT, and maximizing heat transfer the design of the heat exchanger, such as the weave pattern of the 3D woven lattice, can be adjusted separately or in conjunction with the changes to the CFM.

The present invention can take the form of a thermal management unit (TMU) combining a CFM and other cellular materials, such as fin, pin, truss, and foam. The thermal management unit can be optimized for different variables including minimizing ΔP, ΔT, and maximizing heat transfer either alone or in combination. For minimizing ΔP, the design of the CFM and the cellular materials are optimized for minimizing ΔP. Many features of the impinging and collecting tubes and cellular material can be optimized to minimize ΔP, such as: sizes, thicknesses, quantity ratios, arrangements, thickness ratio, individual thickness between the CFM and the cellular material, and the material type and surface roughness of the CFM and the cellular material. For minimizing ΔT, the design of the CFM and the cellular material are optimized for minimizing ΔT. Many features of the impinging and collecting tubes and cellular material can be optimized to minimize ΔT, such as: sizes, thicknesses, quantity ratios, arrangements, thickness ratio, individual thickness between the CFM and the cellular material, and the material type and surface roughness of the CFM and the cellular material. For maximizing heat transfer, the design of the CFM and the cellular material are optimized. Many features of the impinging and collecting tubes and cellular material can be optimized to maximize heat transfer, such as: sizes, thicknesses, quantity ratios, arrangements, thickness ratio, individual thickness between the CFM and the cellular material, and the material type and surface roughness of the CFM and the cellular material. For each of minimizing ΔP, ΔT, and maximizing heat transfer the cellular material can be adjusted separately or in conjunction with the changes to the CFM.

The present invention can take the form of a TMU combining a CFM and a heat exchanger (3D woven lattices, fins, pins, trusses, or foam) for systems with complex cooling requirements. The TMU can be optimized to systems with multiple surfaces that attach to devices and need cooling. The TMU that can be optimized to any geometry to satisfy any flat or curved surfaces which need cooling. The TMU can be optimized to satisfy flow patterns with any desired directions and simultaneously minimize ΔP. The TMU can be optimized to satisfy flow patterns with any desired directions and simultaneously minimize ΔT, and the TMU can be optimized to satisfy flow patterns with any desired directions and simultaneously maximize heat transfer.

It should be noted that the CFMs can be easily graded, expanded and scaled as needed. The CFMs can be repeated and expanded in three directions. The CFMs can be placed with gradients in three directions. The TMC (unit cell) sizes of the CFMs are between 1 mm and 1 m. CFMs can be formed using Cu, Al, or other metals for maximizing heat transfer. Thermally conductive ceramics can also be used while preventing electrical conductivity. Plastic can be used for minimizing weight, cost, and heat dissipation through the CFM. Additive manufacturing can be employed to manufacture a metallic CFM with high speed and great quality, and can also be used to manufacture a plastic CFM with high speed and great quality.

It should be noted that the orientations of the distributors in the CFMs can be adjusted. The angles between inlet and outlet distributors can take any angle between 0 degree (parallel) to 90 degrees (perpendicular) in three directions. The inlet and outlet distributors can be straight, curved or waved channels. The inlet and outlet distributors can either intersect to make a joint connection or be independent.

The complex flow manifold and/or the heat exchanger can also be designed to optimize additional properties of the thermal management unit such as thermal conductivity, electrical conductivity, mechanical strength, material density, energy absorption, or damping properties that may also be required for fluid flow or heat exchange applications.

There are excellent fluidic and thermal properties for multifunctional 3D woven lattice materials under three different flow patterns: axial, bifurcated and focused bifurcated. Among the three applied flow patterns, the axial flow transfers heat more effectively than the other two, while the bifurcated flow pattern possesses better temperature uniformity and lower pressure drops. Thus, neither flow pattern is ideal. However, the high average temperatures, $\overline{T}$, inherent to bifurcated flow can be lowered more readily with higher flow rates than the large variations in temperature, $\Delta T$, can be reduced in the axial flow pattern. In addition, pressure drops are smaller for the bifurcated flow pattern compared to the axial flow pattern.

To improve properties beyond those reported for these ordinary flow patterns, the bifurcated flow pattern is modified to overcome its two main disadvantages. First, in the bifurcated flow pattern a large portion of the fluid enters and exits the 3D weave near its edges and does not interact sufficiently with the 3D weave to facilitate forced convection between the heated solid and the cool fluid. Forcing more of the fluid flow towards the heated substrate and reducing the thickness of the weave moves streamlines closer to the hot substrate and thereby enhances heat transfer. Second, because the maximum and minimum temperatures of the heated substrate occur at the center and the edges of the bifurcated flow pattern, respectively, temperature variations scale with the lateral dimensions of the flow pattern. To reduce the scale of the bifurcated flow and thereby minimize temperature variations, while also accommodating large substrates, complex flow manifolds are designed that can be combined with the metallic weaves or other heat exchangers. This provides the ability to tune local temperature variations for any size substrate while also providing superior fluidic and thermal properties.

Continuous jet impingement of a liquid or gas onto a surface is known to be more effective at removing heat from that surface than forced convection. High-speed jet impingement on a component surface creates a thin boundary layer, and thus a high level of heat transfer. Macro and micro-scale jets have been studied with a variety of fluids and flow schemes and they have been used to cool turbine blades and quench metals. Many of these practical applications employ an array of jets that typically can maintain a more consistent surface temperature and can cool very large areas compared to a single jet. Indeed, heat transfer coefficients of 500,000 and 20,000 $W/m^2K$ can be achieved with sub-millimeter, microjet arrays using water and air, respectively.

While jet impingement devices have shown tremendous success, most of these studies have been performed with the jets spraying fluid onto a substrate through an empty spacing so as to quantify various metrics such as Reynolds number, the Prandtl number, jet diameter, and wall-to-nozzle spacing. By inserting a heat exchanger, such as a metallic weave, between the jets and the heated substrate, heat transfer can be enhanced further. The solid ligaments of the weave will provide higher heat conduction and more surface area for improved heat convection, and the local, regular pores will enhance fluid mixing. A manifold is designed so that the return or exhaust fluid flow does not interfere with the impinging jets, and its thickness is increased from 12.7 mm to 19.0 mm and then to 22.2 mm while the thickness of the weaves (plus face sheet) is decreased from 12.7 mm to 6.4 mm and then to 34.2 mm to maintain a constant total system thickness of 25.4 mm. For comparison, use of the complex fluid manifold alone was also tested for cooling. Pressure drops, average temperatures, temperature variations, and heat transfer coefficients are reported and they are compared to earlier data for axial and bifurcated flow patterns within the same Cu weaves.

EXAMPLES

The exemplary implementations that follow are merely means of illustrating the embodiments, manufacture, uses, and implementations of the present invention. These examples are in no way meant to be considered limiting. Any design for or implementation of the present invention known to or conceivable by one of skill in the art is considered to be within the scope of the present invention.

FIGS. 1A-1D illustrate a schematic diagram and images of the underlying principle of the complex flow manifold of the present invention. More particularly, FIG. 1A illustrates a tubular flow manifold to guide the flow in and out of the weaves, without cross-flow interfering between neighboring jets. FIG. 1B illustrates a perspective view of the flow manifold which measures 76.2 mm×25.4 mm as inlet and outlet areas, and within 25.4 mm as height. FIG. 1C illustrates a top-down view of the inlet area with impinging jet arrays throughout the whole thickness. FIG. 1D illustrates a bottom-up view of the outlet area with extra holes between impinging jet arrays to exhaust the coolant. The exhaust is collected at the outer periphery of the manifold.

The coolant first flows through an array of inlet channels, as illustrated in FIG. 1C and span the manifold's full thickness. Then the coolant flows through the weave and impinges on the heated substrate as an array of high velocity jets (blue arrows in FIG. 1A). Next the coolant returns through the weave and enters a second set of channels, as illustrated in FIG. 1D. These exhaust channels are located between the inlet channels on the bottom surface of the manifold, as illustrated in FIG. 1D, and span only its bottom lip. Thus, the heated, exhaust coolant flows within the hollow structure towards the periphery of the manifold where it is collected and removed (orange arrows in FIG. 1A). The localized exhausting of each jet to the center of the manifold minimizes cross-flow between neighboring jets, within the weave and near the heated surface. This increases cooling efficiency and allows the performance of a single jet or thermal management unit to be replicated over a large area or the full thermal management unit.

Figures 2A, 2B:
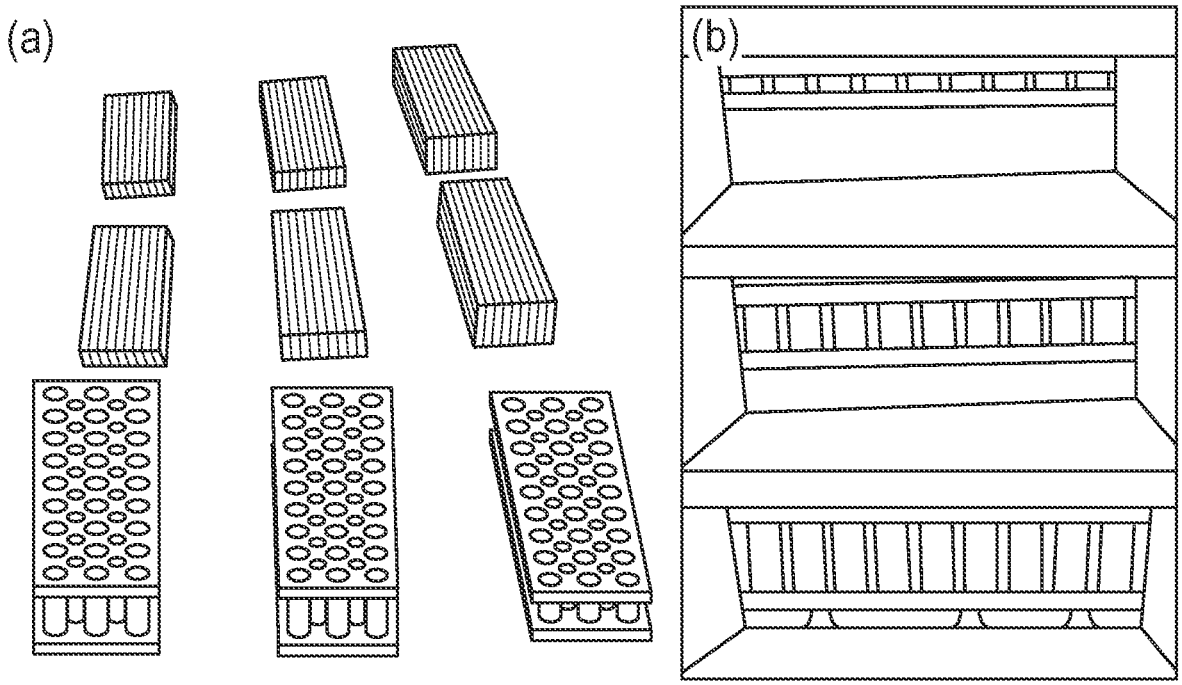
FIG. 2A illustrates a perspective view of each of the weaves as heat exchangers with its corresponding complex flow manifold.
FIG. 2B illustrates side views of the weave combined with their corresponding manifolds. After assembly, the three different combinations are stacked in the testing chamber as illustrated in FIG. 2B.

The two different structures of the 3D woven lattice materials were studied, and both have proven effective in dissipating heat. One is called the "standard" structure and is a fully "dense" weave. The second is called "optimized" as it was topology-optimized by selectively eliminating some wires in two Cartesian directions to enhance fluid permeability with minimal reductions in mechanical stiffness. To accommodate the testing fixture, the mating areas of the manifold and weave are fixed to be 76.2 mm×25.4 mm and the combined thickness of the manifold and weave is 25.4 mm. To study the impact of the ratio between the manifold and the weave thicknesses, both the standard and optimized weaves were sliced using electrical discharge machining (EDM) to three thicknesses, 3.2 mm, 6.4 mm, and 12.7 mm, and they were independently brazed to a 1 mm face sheet. Three manifolds with the thicknesses that are needed to reach a full 25.4 mm thickness, when combined with the weave, were then 3D printed, as illustrated in FIG. 2A. After assembling each manifold with its corresponding weave, each combination is stacked in the testing chamber, as illustrated in FIG. 2B. As illustrated in FIG. 2A both standard and optimized weaves are sliced to three different thicknesses (3.2 mm, 6.4 mm, and 12.7 mm), and three manifolds with corresponding thicknesses are manufactured to enable an overall thickness of 25.4 mm. As illustrated in FIG. 2B three combinations of manifolds and weaves were tested in the testing chamber.

In addition to adjusting thicknesses of the manifolds and weaves to obtain an optimum solution, one can also vary other geometric features of the manifolds such as jet or inlet diameter, return or exhaust port diameter, jet wall thickness, the symmetry of the inlet/exhaust channel patterns, and the materials used to fabricate them. The geometric features of the manifold were held fixed to the values listed in Table 1, but will be varied in future studies.

TABLE 1

The geometric features of the manufactured 3D-printed complex flow manifolds.

| Inlet channel diameter (mm) | Exhaust channel diameter (mm) | Jet wall thickness (mm) | Symmetry of the hole patterns |
|---|---|---|---|
| 4.6 | 2.9 | 0.75 | Square |

Figures 3A, 3B, 3C, 3D, 3E, 3F:
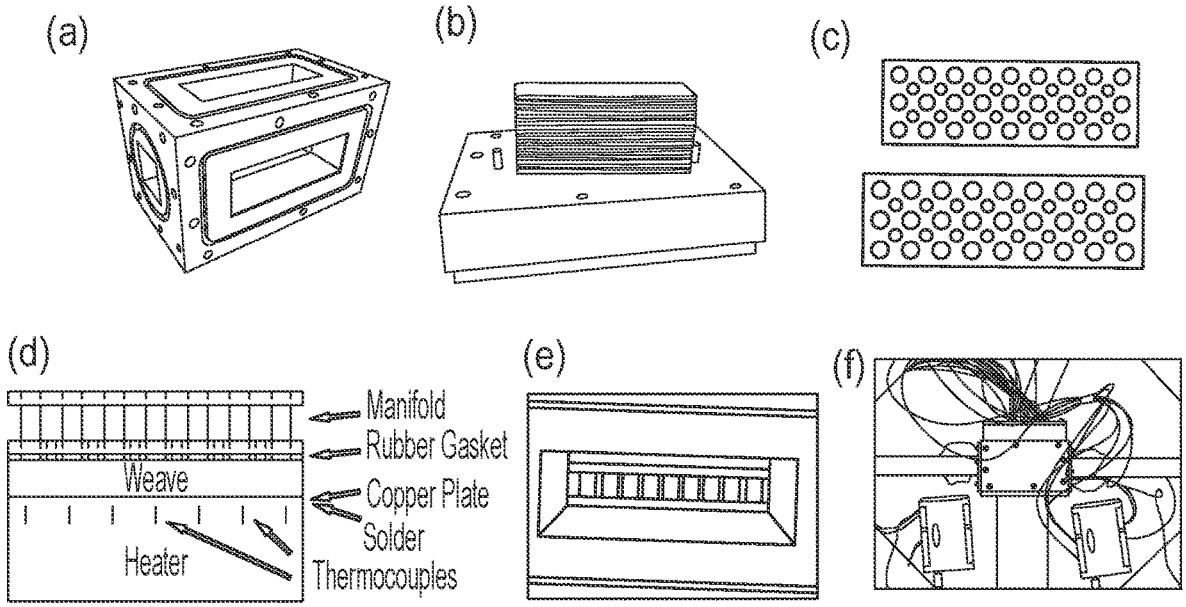
FIG. 3A illustrates a perspective view of the testing apparatus where each side of the versatile chamber contains a window that can allow flow into and out of the chamber or can be closed to prevent flow.
FIG. 3B illustrates a side view of a finished setup of the heating system with the woven Cu heat exchanger soldered to the Cu heating block.
FIG. 3C illustrates a bottom up view of the complex flow manifold and a rubber gasket.
FIG. 3D illustrates a side view schematic of the assembly of manifold, rubber gasket, weave and heater.
FIG. 3E illustrates a side view of the assembly in the chamber (heater cannot be seen).
FIG. 3F illustrates a top down view of the whole testing setup, with the manifold, gasket and weaves assembled in the central chamber.

To quantify pressure drops and heat transfer performance for each of the manifold-weave systems, called thermal management units, a versatile test apparatus was constructed capable of generating 1.5 kW of thermal power over a 76.2 mm×25.4 mm rectangular area. As illustrated in FIG. 3A, fluid can flow into or out of each side of the chamber. For this effort water was the working fluid and it flowed onto one 76.2 mm×25.4 mm face of the chamber while the other 76.2 mm×25.4 mm face was heated. The heated or exhaust water flowed out of two 25.4 mm×25.4 mm faces. As an alternative, four 25.4 mm×25.4 mm faces could be used to expel the heated water. The temperature of the heated surface was measured with seven evenly spaced type T thermocouples with an accuracy of 0.1° C. These thermocouples were calibrated prior to being inserted and soldered into pre-cut blind holes within a Cu heating block. The Cu heating block was then soldered to each 3D woven sample using a lower melting temperature solder. The thermocouples in the heating block reside ~2 mm from the surface that is exposed to the coolant. FIG. 3B illustrates a schematic of the assembled heating system with the woven Cu sample soldered to the Cu heating block. To prevent any water from flowing between the inlet and the outlet ports, due to small mismatches between the bottom surface of the manifold and the top surface of the weave, a thin layer of rubber gasket was fabricated with a pattern of holes that match those on the manifolds, as illustrated in FIG. 3C. The whole assembly of the thermal management unit (manifold, gasket and weave) is inserted into the chamber as illustrated in FIG. 3D (schematic) and FIG. 3E (photo). To guarantee fully developed flow and out of the testing components, arms measuring 254 mm in length were attached to the inlet and outlet ports. On each arm, there is a port for measuring fluid pressure and an Omega TH-44034 thermistor (accuracy: 0.1° C.) for measuring fluid temperature, near the inlet and outlets to the chamber. FIG. 3F illustrates the complete testing setup, with the TMU (manifold, gasket and weave) assembled in the central chamber.

FIG. 3A illustrates a central chamber to fit the sample and adapt the flow patterns. FIG. 3B illustrates a 3D weave soldered to the Cu heating block with embedded cartridge heaters and thermocouples. FIG. 3C illustrates a laser cut rubber gasket to be inserted between manifold and weave to prevent leakage. FIG. 3D illustrates the side view schematic of the assembly of manifold, rubber gasket, weave and heater. FIG. 3E illustrates the side view of the assembly in the chamber (heater cannot be seen). FIG. 3F illustrates an assembly for the pressure drop and heat transfer testing.

To evaluate the performance of the manifolds by themselves, the weaves were replaced with thin plastic frames that created open spaces in place of the weaves, as illustrated in FIGS. 3A-3F. The wall thickness of the 3D printed frames is less than 1 mm so they do not interfere with the water flow into or out of the two sets of channels. Similar experiments were then performed monitoring substrate temperatures, water temperatures and pressure drops.

In porous materials the relationship between pressure gradient and flow rate can be described by the Darcy-Forchheimer equation:

$$\frac{\Delta P}{L} = -\frac{\mu}{K}v - \frac{\rho C_F}{\sqrt{K}}v^2, \tag{1}$$

where ΔP is the pressure drop, L is the sample's length, μ is the fluid's dynamic viscosity, ρ is the fluid's density, v is the fluid's superficial velocity, K is the structure's permeability, and $C_F$ is a dimensionless form-drag coefficient. $C_F$ was initially thought to be a universal constant, with a value of approximately 0.55, but later it was found that $C_F$ does vary with the nature of the porous medium and can be as low as 0.1. This equation is generally used to describe turbulent flow when inertial effects become significant and the dimensionless parameter Reynolds number Re is greater than 10. The definition of Reynolds number is:

$$Re = \frac{\rho D_h}{\mu}v, \tag{2}$$

where $D_h$ is the hydraulic diameter of the structure. The hydraulic diameters for the standard and optimized structures are 297 and 470 μm, respectively. When Re is less than 1, flow is assumed to be in the laminar region and Eq. (1) can be simplified to the Darcy's law by eliminating the quadratic term. Here, Eq. (1) is used as a more general form.

For heat transfer measurements, the applied electrical power was fixed by maintaining the voltage at the transformer, and the heat transfer into the coolant through the Cu weaves was calculated by measuring the temperature difference of coolant between inlet and outlet:

$$Q=c_f\rho vA(T_{out}-T_{in}), \tag{3}$$

where Q is the heat transferred to the coolant per second, $c_f$ is the heat capacity of coolant, A is the cross section area, and $T_{in}$ and $T_{out}$ are the inlet and outlet temperature of the coolant. where Q is the heat transferred to the coolant per second, $c_f$ is the heat capacity of coolant, A is the cross section area, and $T_{in}$ and $T_{out}$ are the inlet and outlet temperature of the coolant.

A heat transfer coefficient is commonly used to describe the efficiency of forced convection in a heat exchanger, which by definition is:

$$h=\frac{Q}{A_{heated}(T_s-T_f)}=\frac{Q}{A_{heated}(T_s-(T_{out}+T_{in})/2)}, \tag{4}$$

where $A_{heated}$ is the heated surface area (76.2×25.4 mm in all cases), $T_s$ is the average of the seven temperatures measured by the thermocouples located near the surface of the heated block, and $T_f$ is the average fluid temperature $((T_{out}+T_{in})/2)$.

Figure 4:
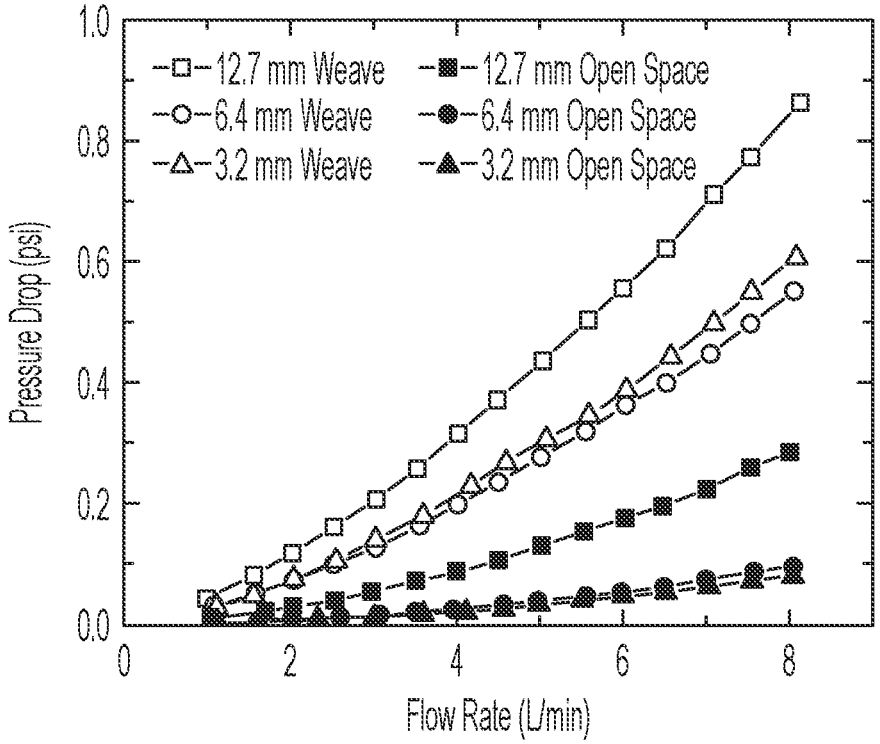
FIG. 4 illustrates pressure drop measurements for combinations of manifolds with either weaves or open spaces. The overall thickness is 25.4 mm and in three circumstances the weaves' thicknesses are separately 12.7 mm, 6.4 mm and 3.2 mm.

FIG. 4 illustrates pressure drops that were measured at different flow rates for different thicknesses of the optimized weaves that were combined with the appropriate manifolds to create a 25.4 mm inch overall height. When combining manifolds with open spaces, the pressure drops are much lower. Between the three flow patterns, it can be seen that the 6.4 mm thick weave+19.0 mm thick manifold show the lowest overall pressure drop. This is due to the fact that pressure drop decreases when the thickness of either the weave or the manifold decreases. The overall effect is that when both weave and manifold are at intermediate thickness (6.4 mm thick weave+19.0 mm thick manifold), the overall pressure drop is the lowest.

Figure 5:
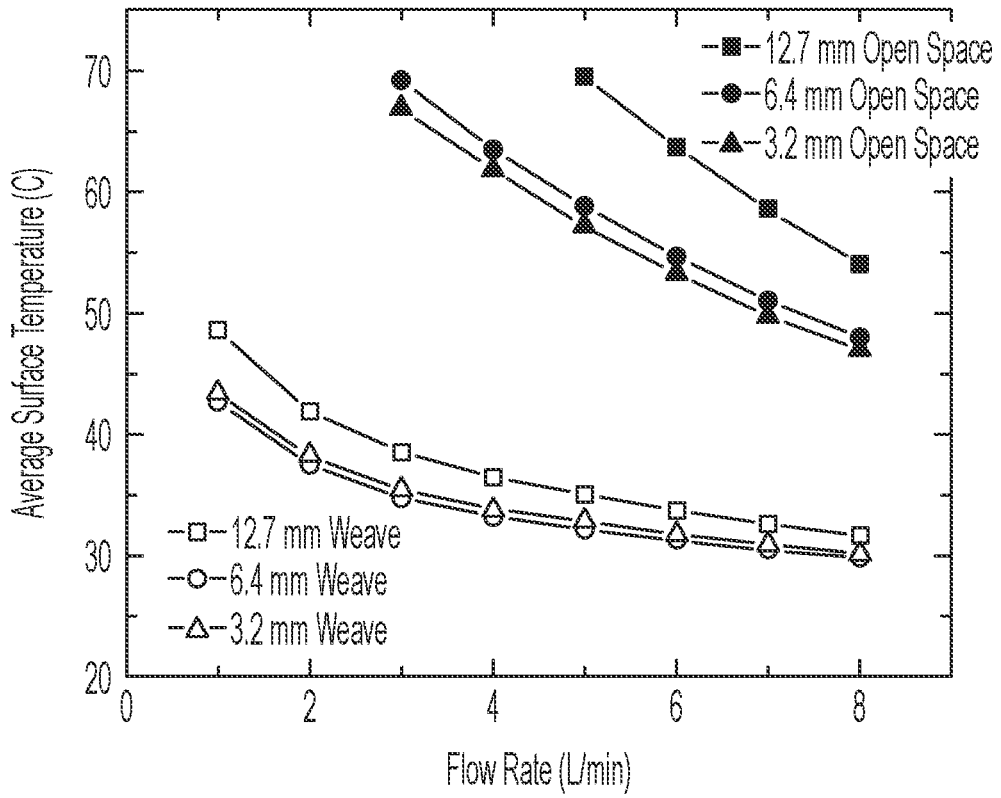
FIG. 5 illustrates average surface temperatures of the weaves/manifolds and open spaces/manifold systems at three different thickness ratios. The overall thickness is 25.4 mm in all cases.

Using the seven thermocouples that measure temperature very close to the cooled surface, the average surface temperature ($\bar{T}$) was quantified which depends on weave architecture, flow pattern, and flow rate. A series of experiments were conducted by applying 400 W to the heater block while cooling with water and a combination of a manifold and either an optimized weave or an open space. The thickness of the weave or open space is 12.7 mm, 6.4 mm and 3.2 mm and the manifold occupies the remaining space of the overall 25.4 mm thickness. As a result, three different thickness ratios between manifold and weave and manifold and open space were studied. FIG. 5 illustrates average surface temperatures of the manifolds+ weaves and manifolds+open spaces at three different thickness ratios. The overall thickness is 25.4 mm in all cases.

A couple of trends can be observed in FIG. 5. First, the faster the fluid flows, the lower the average surface temperature. Second, the average surface temperature drops significantly when the manifold is combined with a weave rather than an open space. The weaves fill much of the space with solid ligaments that dissipate heat to the water via thermal conduction and provide more surface area for enhancing thermal convection. Lastly, between the three different ratios, again the combination of the 6.4 mm thick weave and the 19.0 mm thick manifold shows the best performance which in this case is the lowest overall surface temperature. This performance is attributable to two factors that compete with each other: (1) the volume of wires that are available to conduct and convect heat, and (2) the proximity of the streamlines to the substrate. When the weave is thick, more wires are available to enhance thermal conduction and convection, but less coolant can travel through the full weave to reach the surface of the substrate. Conversely, when the weave is thin, fewer wires are available to enhance thermal conduction and convection, but more coolant reaches the surface of the substrate. Overall the intermediate manifold/weave thickness ratio displays the best performance of the ones considered in FIG. 5. In the case of open spaces, though, thinner open spaces allow more direct impingement of the coolant on the substrate and hence show the best performance in FIG. 5.

Figure 6:
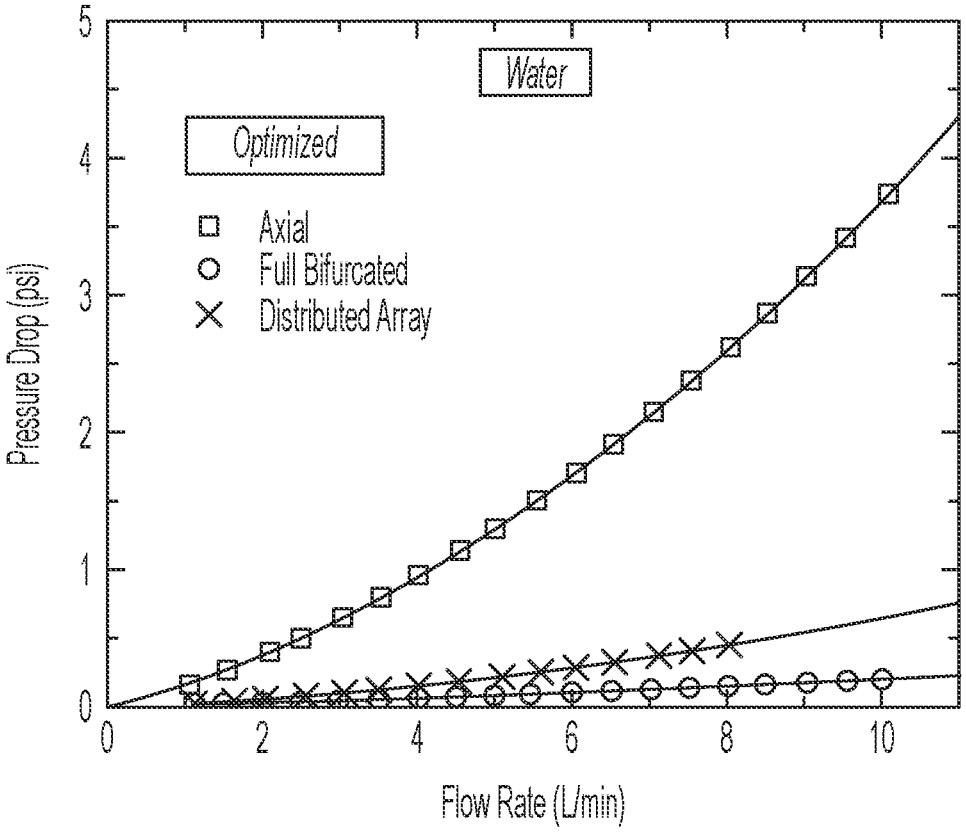
FIG. 6 illustrates comparison of pressure drop vs. flow rate between three flow patterns: axial, bifurcated and weave/manifold distributed array. The axial and bifurcated flow patterns were performed on full 25.4 mm thick optimized woven blocks, while the distributed array flow pattern was performed on the combination of a 6.4 mm thick optimized woven block heat exchangers and a 19.0 mm thick complex flow manifold.

Pressure drops for a 6.4 mm thick optimized woven heat exchanger and a 19.0 mm thick complex flow manifold are compared to those for axial and bifurcated flow patterns using full, 25.4 mm thick woven heat exchangers in FIG. 6. The highest, intermediate and the lowest pressure drops occur under axial flow, manifold/weave distributed array flow, and bifurcated flow, respectively. The highest pressure drops that are seen for the axial flow are attributed to this system's much longer flow paths in the weave, while the lowest pressure drops record for the bifurcated flow are attributed to this system's short flow paths due to edge effects. The distributed array has a relatively short flow path within the weave as well but the 180 degree turn from the inlet to outlet channels increases the resistance to flow and hence raises the pressure drop across the system. However, note that the pressure drop for the distributed array system only exceeds that of the bifurcated flow slightly and thus would not increase pumping requirements significantly. FIG. 6 illustrates comparison of pressure drop vs. flow rate between three flow patterns: axial, bifurcated and manifold/weave distributed array. The axial and bifurcated flow patterns were performed on full 25.4 mm thick optimized woven blocks, while the distributed array flow pattern was performed on the combination of a 6.4 mm thick optimized woven heat exchanger and a 19.0 mm thick complex flow manifold.

Figure 7:
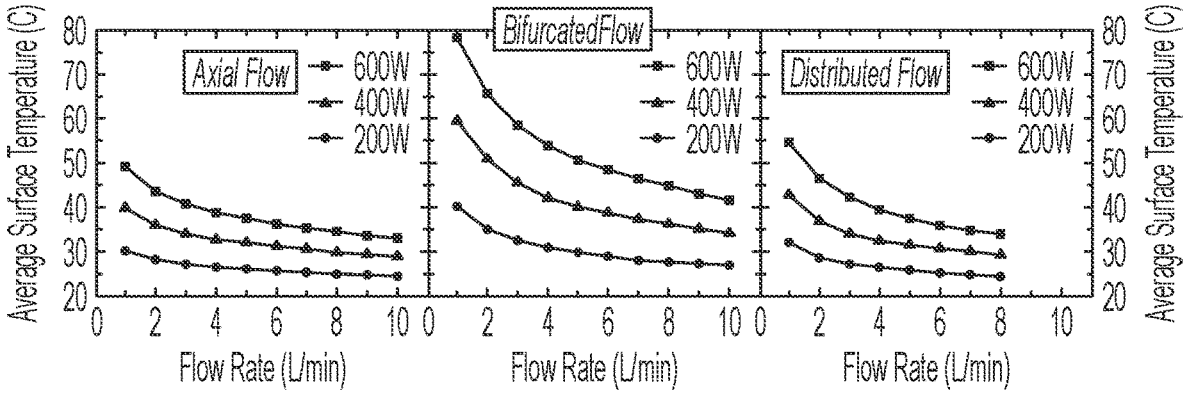
FIG. 7 illustrates average surface temperature vs. flow rate for three flow patterns on an optimized weave with three different heat fluxes individually applied (600 W, 400 W and 200 W). For the weave/manifold distributed array flow, the experiments were performed on the combination of a 6.4 mm thick optimized woven block and a 19.0 mm thick flow manifold.
Figure 8:
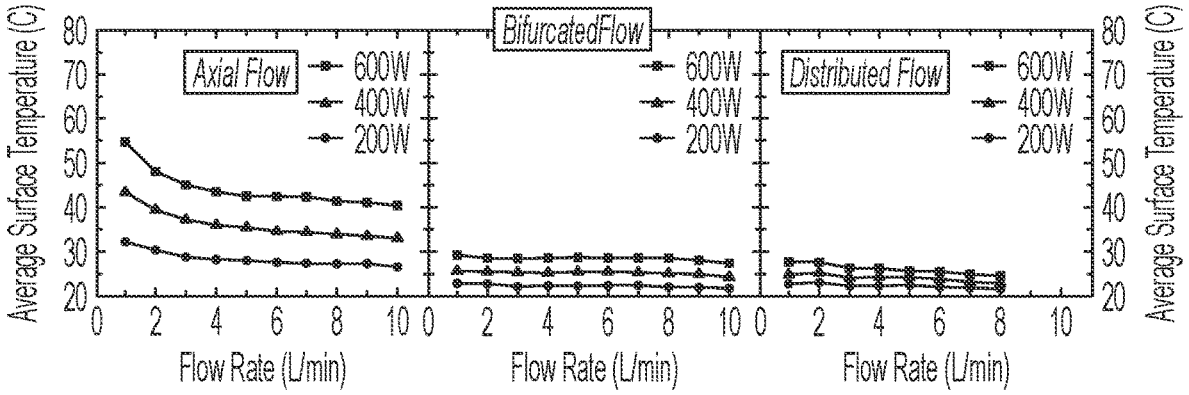
FIG. 8 illustrates $\Delta T$ across the surface vs. flow rate for three flow patterns within an optimized weave with three different heat fluxes applied (600 W, 400 W and 200 W). For the weave/manifold distributed array, the experiments were performed on the combination of a 6.4 mm thick optimized woven block and a 19.0 mm thick flow manifold.

Similar tests were performed to compare average surface temperature $\bar{T}$ and temperature uniformity $\Delta T$ between the distributed array and the axial and bifurcated flow systems. Three different input powers (600 W, 400 W and 200 W) were adopted and the coolant flow rates changed systematically. FIGS. 7 and 8 illustrate the results. FIG. 7 illustrates a graphical view of heat transfer coefficient vs. flow rate with three flow patterns on an optimized weave with three different heat fluxes individually applied (600 W, 400 W and 200 W). FIG. 8 illustrates $\Delta T$ across the surface vs. flow rate for three flow patterns within an optimized weave with three different heat fluxes applied (600 W, 400 W and 200 W). For the manifold/weave distributed array, the experiments were performed on the combination of a 6.4 mm thick optimized woven heat exchanger and a 19.0 mm thick complex flow manifold.

Figure 9:
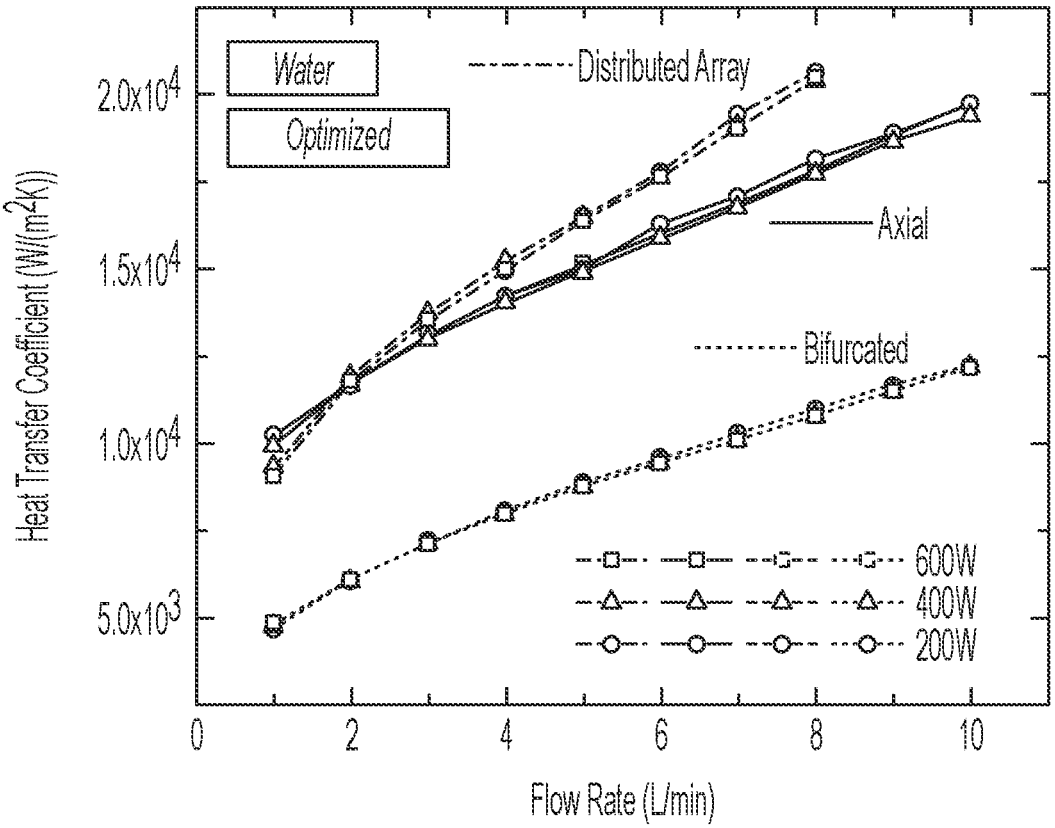
FIG. 9 illustrates heat transfer coefficient vs. flow rate for three flow patterns within an optimized weave with three different heat fluxes applied (600 W, 400 W and 200 W). For the weave/manifold distributed array, the experiments were performed on the combination of a 6.4 mm thick optimized woven block and a 19.0 mm thick flow manifold.

As illustrated in FIGS. 7 and 8, the manifold/weave distributed array reduces both $\bar{T}$ and $\Delta T$ substantially compared to the case of the bifurcated flow. Compared to the axial flow case, $\bar{T}$ for the distributed array flow is slightly higher at low flow rates but comparable at higher flow rates. This is due to the fact that while the streamlines of the axial flow do not depend on flow rates, the streamlines of the distributed array tend to reach deeper and thus closer to the heated surface at higher flow rates compared to low flow rates. This shift enhances heat transfer. This can also be confirmed from the comparison of heat transfer coefficients that are illustrated in FIG. 9 and were calculated using Eq. (4). The distributed array flow exhibits superior heat transfer capabilities compared to other flow patterns when flow rate increases. FIG. 9 illustrates heat transfer coefficient vs. flow rate for three flow patterns within an optimized weave with three different heat fluxes applied (600 W, 400 W and 200 W). For the manifold/weave distributed array, the experiments were performed on the combination of a 6.4 mm thick optimized woven heat exchanger and a 19.0 mm thick complex flow manifold.

The results in FIGS. 7-9 demonstrate that the new manifold/weave distributed array flow pattern possesses better heat transfer capabilities and temperature uniformities than the previously studied axial and bifurcated flow patterns, without significant increases in pressure drop. In addition, the volume of the weave is reduced by 75% compared to the previous 25.4 mm thick woven heat exchangers. Several explanations and comments can be offered for the superior performances of the distributed array flow pattern. First, the manifold/weave combination or thermal management unit leads the fluid closer to the heated surface, which enhances heat transfer by creating a larger temperature gradient between the heated solid and the cooling fluid. Second, the patterns of the inlet and outlet channels allow the full surface area to be segmented into many unit cells (TMCs), which dramatically increases temperature uniformity. Once the properties in one unit cell are optimized, they can be distributed across a large surface area by merely repeating the unit cell (TMC) pattern within the manifold. Third, simulations can be performed on a single TMC, to study the influence of different geometric features, such as inlet channel diameter, exhaust channel diameter, thickness ratio between manifold and heat exchanger media, etc. Lastly, the choice of adding a heat exchanger to a manifold is not limited to 3D woven lattice materials, but can also be broadened to other common porous metallic materials such as foams, fins, pins, and trusses. The complex flow manifold and/or the heat exchanger can also be designed to optimize additional properties of the thermal management unit such as thermal conductivity, electrical conductivity, mechanical strength, material density, energy absorption, or damping properties that may also be required for fluid flow or heat exchange applications.

Figure 10:
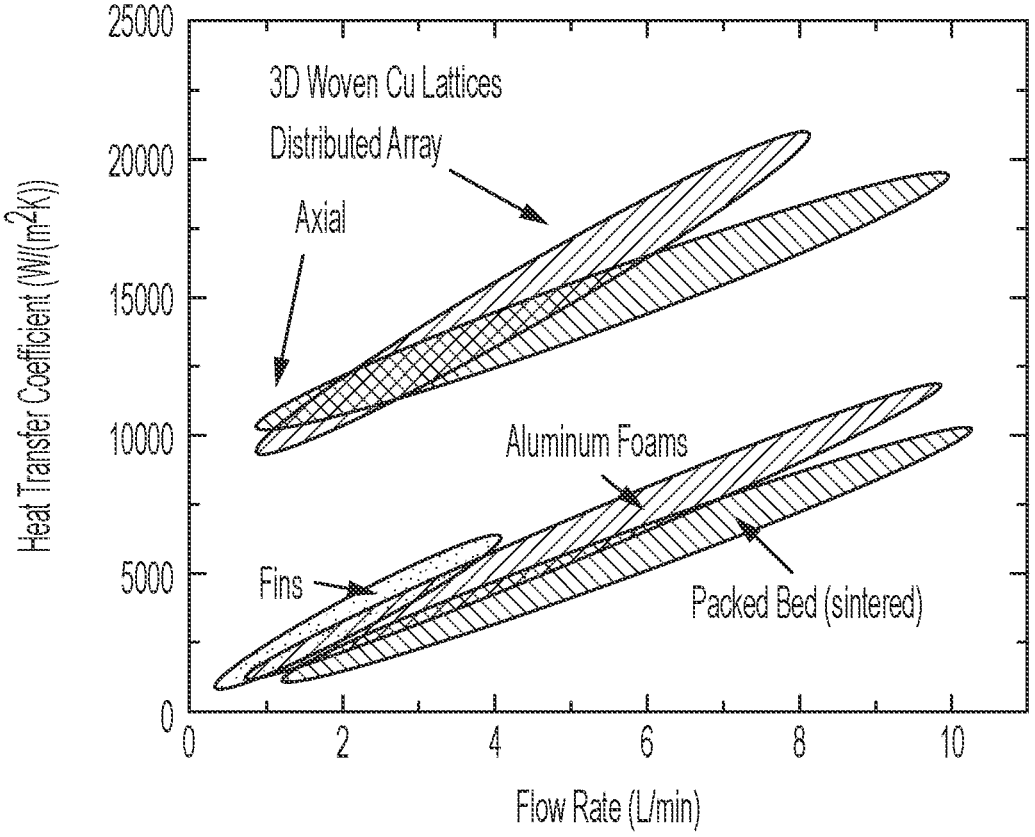
FIG. 10 illustrates comparison of heat transfer coefficient vs. volumetric flow rate between a 3D Cu weave adopting either a distributed array or an axial flow pattern with other heat exchanger porous materials including fins, foams and sintered packed beds.

For a final comparison the data from FIG. 9 was combined with data for other common heat exchange porous materials including foams, fins and packed beds in FIG. 10. The results suggest that for a given volumetric flow rate, the thermal management units, consisting of a complex flow manifold and a weave as a heat exchanger, show ~2× greater heat transfer performance than other common heat exchange media. This is particularly important for applications requiring maximum heat dissipation with constraints on the capabilities of delivering large amount of coolant. While not captured in FIG. 10, the distributed array of the manifold/weave thermal management unit also offers unique temperature uniformity even for small weave volumes, which will be very beneficial in many applications. FIG. 10 illustrates comparison of heat transfer coefficient vs. volumetric flow rate between 3D Cu weave adopting either distributed array or axial flow pattern with other heat exchanger porous materials including fins, foams and sintered packed beds.

While this combination of a manifold and a 3D weave has proven attractive compared to other heat exchange systems, the designs of the manifold and the weave have not yet been optimized. One could utilize topology optimization to either optimize the geometric parameters of the current system or come up with a new structural design combining the manifold and weave as one piece. With the help of arising 3D printing techniques, many novel mathematical designs can now be realized despite their complex shapes. This may enable design of more effective heat exchanger systems that address the ever-increasing thermal load requirements of high power electronic devices and other heat producing systems.

Figures 11A, 11B, 11C, 11D:
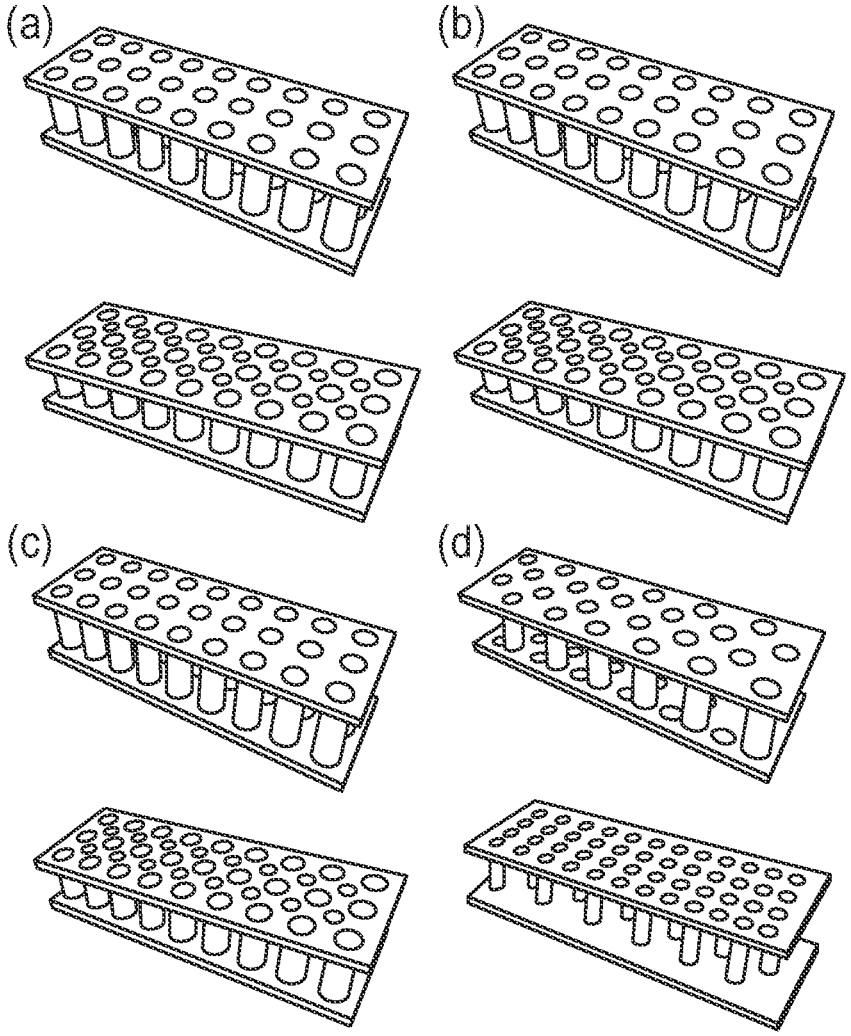
FIGS. 11A-11D illustrate four examples of different complex flow manifold designs, according to an embodiment of the present invention.

As an example of optimizing the geometric parameters, four different design patterns of the complex flow manifolds are shown in FIGS. 11A-11D, including the one introduced in Table 1. The three additional designs are meant to satisfy different functions: (a) same inlet and outlet hole diameter, as illustrated in FIG. 11A; (b) inlet/outlet hole diameter ratio is 1.6, as illustrated in FIG. 11B; (c) same inlet and outlet total areas, as illustrated in FIG. 11C; (d) same inlet and outlet hole diameter and total areas, and the inlets are oriented 45 degrees to each other, as illustrated in FIG. 11D. The studies of these and other manifold designs will be conducted in the near future. FIGS. 11A-11D illustrate four examples of different manifold designs.

A non-transitory computer readable medium that can be read and executed by any computing device can be used for implementation of the computer based aspects of the present invention. The non-transitory computer readable medium can take any suitable form known to one of skill in the art. The non-transitory computer readable medium is understood to be any article of manufacture readable by a computer. Such non-transitory computer readable media includes, but is not limited to, magnetic media, such as floppy disk, flexible disk, hard disk, reel-to-reel tape, cartridge tape, cassette tapes or cards, optical media such as CD-ROM, DVD, Blu-ray, writable compact discs, magneto-optical media in disc, tape, or card form, and paper media such as punch cards or paper tape. Alternately, the program for executing the method and algorithms of the present invention can reside on a remote server or other networked device. Any databases associated with the present invention can be housed on a central computing device, server(s), in cloud storage, or any other suitable means known to or conceivable by one of skill in the art. All of the information associated with the application is transmitted either wired or wirelessly over a network, via the interne, cellular telephone network, RFID, or any other suitable data transmission means known to or conceivable by one of skill in the art. A specialized and novel computing device that is configured to execute the method of the present invention is also included within the scope of the invention.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

The invention claimed is:

1. A thermal management unit, comprising:

a heat exchange device, wherein the heat exchange device is comprised of lattice materials, and wherein the heat exchange device is disposed adjacent to a bottom surface of a manifold to thereby increase temperature uniformity of a distributed array flow pattern associated with the thermal management unit; and the manifold, comprising:

a body having a top surface and the bottom surface;

a set of inlet channels, wherein the set of inlet channels are configured as columns that extend from the top surface to the bottom surface, without extending beyond the bottom surface to thereby increase temperature uniformity of the distributed array flow pattern associated with the thermal management unit, wherein an interior of the manifold extending from the bottom surface to the top surface between inlet channels, of the set of inlet channels, is hollow, wherein the set of inlet channels are open from the top surface to receive fluid, wherein the fluid is received only through the top surface, and wherein the fluid is to flow out of the bottom surface of the manifold and into the heat exchange device to locally cool the heat exchange device;

a set of exhaust openings configured to receive the fluid from the heat exchange device, wherein the set of exhaust openings are disposed on the bottom surface and interspersed between the set of inlet channels so as to direct the fluid back into the hollow interior of the manifold through the set of exhaust openings, and wherein the fluid exits the interior of the manifold along side edges of the manifold.

2. The thermal management unit of claim 1, wherein the manifold is formed from one chosen from a group consisting of a non-metal, such as a polymer or a ceramic, a mixture of materials, and different materials used in different portions of the manifold.

3. The thermal management unit of claim 1, wherein the manifold is additive manufactured with plastics.

4. The thermal management unit of claim 1, wherein diameters of the set of inlet channels and the set of exhaust openings are the same or different.

5. The thermal management unit of claim 1, wherein the fluid is at least one of:

water, air, or other coolants.

6. The thermal management unit of claim 1, wherein the manifold is repeated and expanded in three directions to cool multiple surfaces of the heat exchange device.

7. The thermal management unit of claim 1, wherein the manifold is placed with gradients in three directions.

8. The thermal management unit of claim 1, wherein the set of inlet channels are one of:

straight, curved, or waved.

9. The thermal management unit of claim 1, wherein the set of inlet channels and the set of exhaust openings are configured to one of:

intersect at a joint connection, or be independent of each other.

10. The thermal management unit of claim 6, wherein angles between the set of inlet channels and the set of exhaust openings include any angle between 0 degrees (parallel) to 90 degrees (perpendicular) in the three directions to cool the multiple surfaces of the heat exchange device.

11. The thermal management unit of claim 1, wherein topology optimization is performed so as to design the manifold with properties that are optimized in one or more directions.

12. The thermal management unit of claim 1, wherein fluid flow within the manifold can be designed so as to also optimize thermal conductivity, electrical conductivity, mechanical strength, material density, energy absorption, or damping properties required for fluid flow applications.

13. The thermal management unit of claim 1, wherein the set of exhaust openings extend from the bottom surface to the interior of the manifold.

14. The thermal management unit of claim 1, wherein the set of exhaust openings open into the hollow interior of the manifold.

15. The thermal management unit of claim 1, wherein the set of exhaust openings open into the hollow interior of the manifold so as to allow the fluid to flow around the inlet channels after the fluid is directed back into the hollow interior of the manifold.

16. The thermal management unit of claim 1, further comprising:

a gasket with a pattern of first holes that match a pattern of second holes associated with the inlet channels and the set of exhaust opening, wherein the gasket is configured to be between the heat exchange device and the manifold.

17. The thermal management unit of claim 1, wherein the lattice materials are topology-optimized by selectively eliminating one or more wires in two Cartesian directions to enhance permeability with minimal reductions in mechanical stiffness.

18. A thermal management unit, comprising:

a heat exchange device, wherein the heat exchange device is comprised of lattice materials, and wherein the heat exchange device is disposed adjacent to a bottom surface of a manifold to thereby increase temperature uniformity of a distributed array flow pattern associated with the thermal management unit; and the manifold, comprising:

a body having a top surface and the bottom surface;

a set of inlet channels, wherein the set of inlet channels are configured as columns that extend from the top surface to the bottom surface, without extending beyond the bottom surface to thereby increase temperature uniformity of the distributed array flow pattern associated with the thermal management unit, wherein an interior of the manifold extending from the bottom surface to the top surface between inlet channels, of the set of inlet channels, is hollow, wherein the set of inlet channels are open from the top surface to receive fluid, wherein the fluid is received only through the top surface, and wherein the fluid is to flow out of the bottom surface of the manifold and into the heat exchange device to locally cool the heat exchange device; and a set of exhaust openings are configured to receive the fluid from the heat exchange device, wherein the set of exhaust openings are disposed on the bottom surface and interspersed between the set of inlet channels so as to direct the fluid back into the hollow interior of the manifold through the set of exhaust openings, and wherein the fluid exits the interior of the manifold along side edges of the manifold.

19. The thermal management unit of claim 18, wherein the manifold is formed from a metal.

20. The thermal management unit of claim 18, wherein the manifold is formed from one chosen from a group consisting of a non-metal, such as thermoplastic or ceramic, a mixture of materials, and different materials used in different portions of the manifold.

21. The thermal management unit of claim 18, wherein the manifold is additive manufactured with metals.

22. The thermal management unit of claim 18, wherein the manifold is additive manufactured with plastics.

23. The thermal management unit of claim 18, wherein diameters of the set of inlet channels and the set of exhaust openings are a same or different.

24. The thermal management unit of claim 18, wherein the fluid is at least one of:

water, air, or other coolants.

25. The thermal management unit of claim 18, wherein the manifold is repeated and expanded in three directions to cool multiple surfaces of the heat exchange device.

26. The thermal management unit of claim 18, wherein the manifold is placed with gradients in three directions.

27. The thermal management unit of claim 18, wherein the set of inlet channels and the set of exhaust openings are one of:

straight, curved, or waved channels.

28. The thermal management unit of claim 18, wherein the set of inlet channels and the set of exhaust openings are configured to at least one of:

intersect at a joint connection, or be independent of each other.

29. The thermal management unit of claim 25, wherein angles between the set of inlet channels and the set of exhaust openings include any angle between 0 degrees (parallel) to 90 degrees (perpendicular) in three directions to cool the multiple surfaces of the heat exchange device.

30. The thermal management unit of claim 18, wherein topology optimization is performed so as to design the thermal management unit with properties that are optimized in one or more directions.

31. The thermal management unit of claim 18, wherein the heat exchange device in the thermal management unit comprises one selected from a group consisting of 3D structures, 3D woven lattices, fins, pins, trusses, foams or other cellular materials.

32. The thermal management unit of claim 18, wherein the thermal management unit can be accommodated to systems with multiple surfaces which attach to devices and need cooling.

33. The thermal management unit of claim 18, wherein the set of exhaust openings extend from the bottom surface to the interior of the manifold.

34. The thermal management unit of claim 31, wherein the heat exchange device comprises a three dimensional (3D) woven lattice.

35. The thermal management unit of claim 34, wherein the 3D woven lattice is optimized to enhance fluid permeability in at least one direction.

36. A thermal management unit, comprising:

a heat exchange device, wherein the heat exchange device is comprised of lattice materials, and wherein the heat exchange device is disposed adjacent to a bottom surface of a device to thereby increase temperature uniformity of a distributed array flow pattern associated with the thermal management unit; and the device, comprising:

a body having a top surface and the bottom surface, the body comprising;

a set of inlet channels, wherein the set of inlet channels are configured as columns that extend from the top surface to the bottom surface, without extending beyond the bottom surface to thereby increase temperature uniformity of the distributed array flow pattern associated with the thermal management unit, wherein an interior of the device extending from the bottom surface to the top surface between inlet channels, of the set of inlet channels, is hollow, wherein the set of inlet channels are open from the top surface to receive fluid, wherein the fluid is received only through the top surface, and wherein the fluid is to flow out of the bottom surface of the device and into the heat exchange device to locally cool the heat exchange device; and a set of exhaust openings, wherein the set of exhaust openings are configured to receive the fluid from the heat exchange interface, wherein the set of exhaust openings are disposed on the bottom surface and interspersed between the set of inlet channels so as to direct the fluid back into the hollow interior of the device through the set of exhaust openings, and wherein the fluid exits the interior of the device towards side edges of the device.

37. The thermal management unit of the claim 36, wherein the set of inlet channels are independent of the set of exhaust openings.

38. The thermal management unit of claim 36, wherein the set of exhaust openings extend from the bottom surface to the interior of the device.

* * * * *